US005921260A

United States Patent [19]

Carter

[11] Patent Number: 5,921,260

[45] **Date of Patent: *Jul. 13, 1999**

[54] COLLAPSIBLE SHELTER WITH FLEXIBLE COLLAPSIBLE CANOPY

[76] Inventor: Mark C. Carter, 10131 Kernwood Ct., Alta Loma, Calif. 91737

[ * ] Notice: This patent is subject to a terminal disclaimer.

[21] Appl. No.: 09/025,897

[22] Filed: Feb. 18, 1998

Related U.S. Application Data

[63] Continuation of application No. 08/823,616, Mar. 25, 1997, Pat. No. 5,797,412, which is a continuation of application No. 08/604,801, Feb. 23, 1996, Pat. No. 5,632,293, which is a continuation of application No. 08/279,476, Jul. 25, 1994, Pat. No. 5,511,572.

[51] Int. Cl.[6] ..... E04H 15/50

[52] U.S. Cl. ..... 135/145; 135/151; 135/127; 403/119; 52/641

[58] Field of Search ..... 135/127, 130, 135/131, 144, 145, 147, 151, 155, 152, 143, 114; 403/119, 161, 162, 163; 52/641, 646

[56] References Cited

U.S. PATENT DOCUMENTS

| | | | |
|---|---|---|---|
| 402,755 | 5/1889 | Lyon | 135/151 X |
| 1,712,836 | 5/1929 | Mills . | |
| 1,853,367 | 4/1932 | Mace . | |
| 2,723,673 | 11/1955 | Call | 135/147 X |
| 3,810,482 | 5/1974 | Beavers | 135/147 |
| 4,125,249 | 11/1978 | Zen | 403/119 X |
| 4,450,971 | 5/1984 | Kashiwahara | 403/161 X |
| 4,601,301 | 7/1986 | Hermanson | 135/25 |
| 4,607,656 | 8/1986 | Carter | 135/110 |
| 4,641,676 | 2/1987 | Lynch | 135/110 |
| 4,779,635 | 10/1988 | Lynch | 135/145 X |
| 4,827,958 | 5/1989 | Cantwell et al. | 135/127 |
| 4,877,044 | 10/1989 | Cantwell et al. | 135/127 |
| 4,885,891 | 12/1989 | Lynch | 52/646 |
| 4,941,500 | 7/1990 | Emard | 135/141 |
| 4,945,584 | 8/1990 | LaMantia | 135/127 X |
| 4,947,884 | 8/1990 | Lynch | 135/145 X |
| 4,950,100 | 8/1990 | Horgas | 403/119 X |
| 5,035,253 | 7/1991 | Bortles | 135/89 |
| 5,069,572 | 12/1991 | Niksic | 135/145 X |
| 5,244,001 | 9/1993 | Lynch | 135/103 |
| 5,275,188 | 1/1994 | Tsai | 135/97 |
| 5,361,794 | 11/1994 | Brady | 135/147 |
| 5,421,356 | 6/1995 | Lynch | 135/145 |
| 5,423,341 | 6/1995 | Brady | 135/139 |
| 5,485,863 | 1/1996 | Carter | 135/145 |
| 5,490,533 | 2/1996 | Carter | 135/145 |
| 5,511,572 | 4/1996 | Carter | 135/145 |
| 5,632,292 | 5/1997 | Carter | 135/151 X |
| 5,632,293 | 5/1997 | Carter | 135/145 |
| 5,797,412 | 8/1998 | Carter | 135/151 X |
| 5,813,425 | 9/1998 | Carter | 135/145 |

FOREIGN PATENT DOCUMENTS

| | | |
|---|---|---|
| 2564988 | 11/1988 | Australia . |
| 1241963 | 8/1960 | France . |
| 753183 | 7/1956 | United Kingdom . |
| 92/12313 | 7/1992 | WIPO . |

*Primary Examiner*—Carl D. Friedman
*Assistant Examiner*—Winnie Yip
*Attorney, Agent, or Firm*—Fulwider Patton Lee & Utecht, LLP

[57] ABSTRACT

The collapsible shelter includes a truss and canopy framework that permits a flexible, collapsible canopy to be moved between a raised position and a lowered position. The collapsible shelter includes at least three legs supporting flexible poles removably mounted to the tops of the legs and forming the framework of the canopy. X-shaped truss pairs of link members are connected to each of the legs on each side of the shelter between adjacent legs.

3 Claims, 9 Drawing Sheets

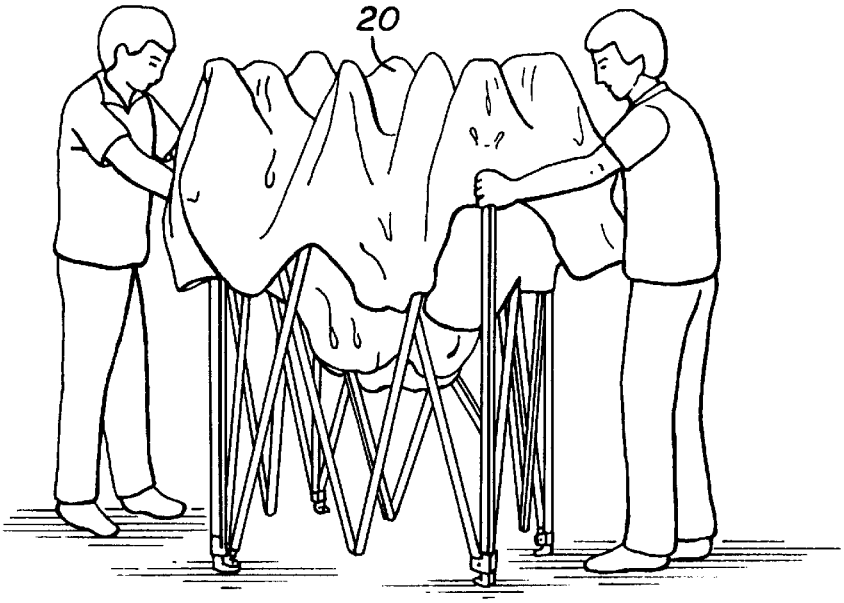
FIG. 2
FIG. 3
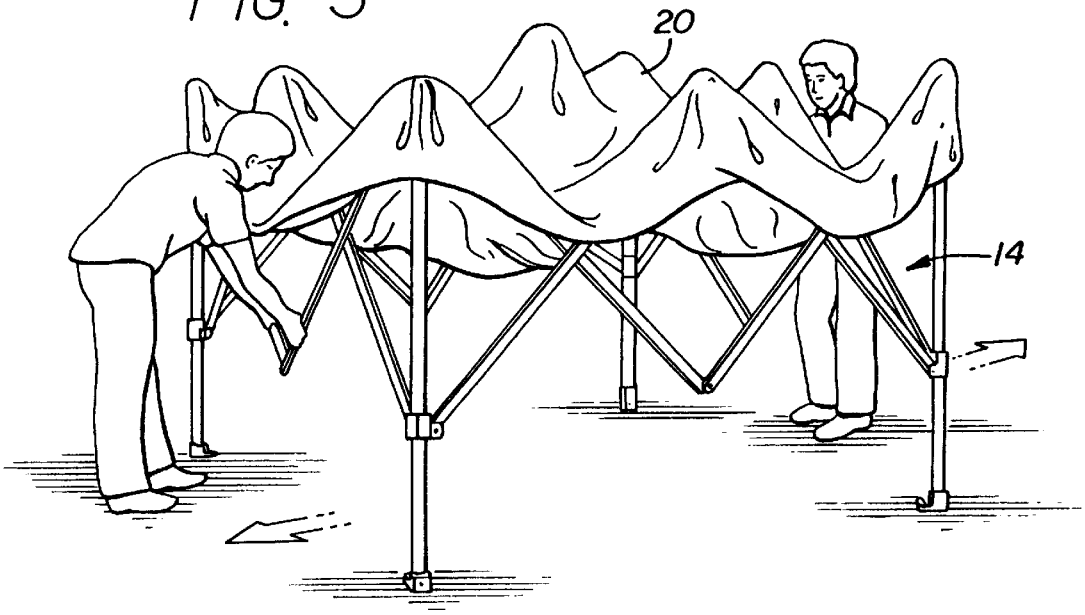

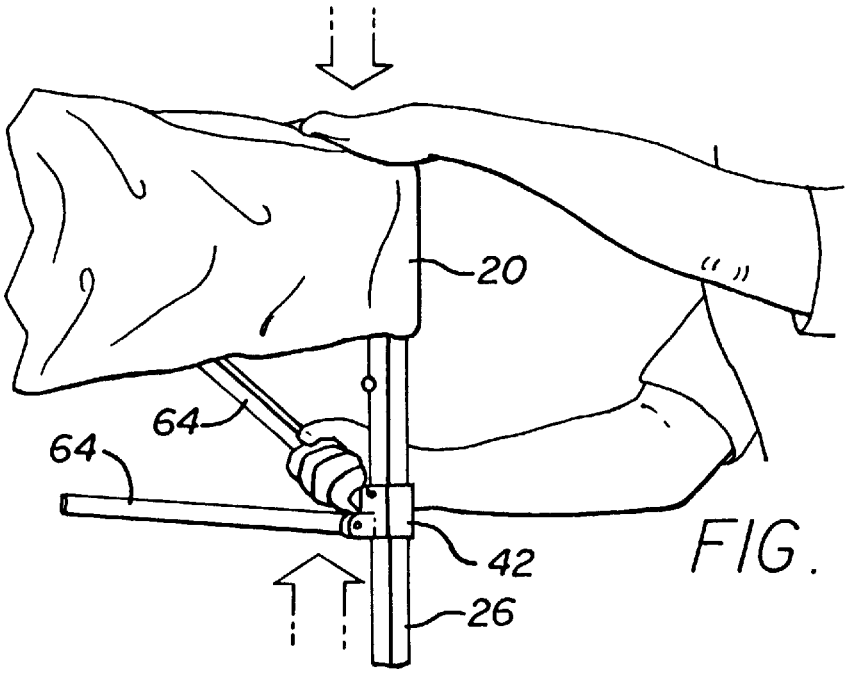
FIG. 4
FIG. 5
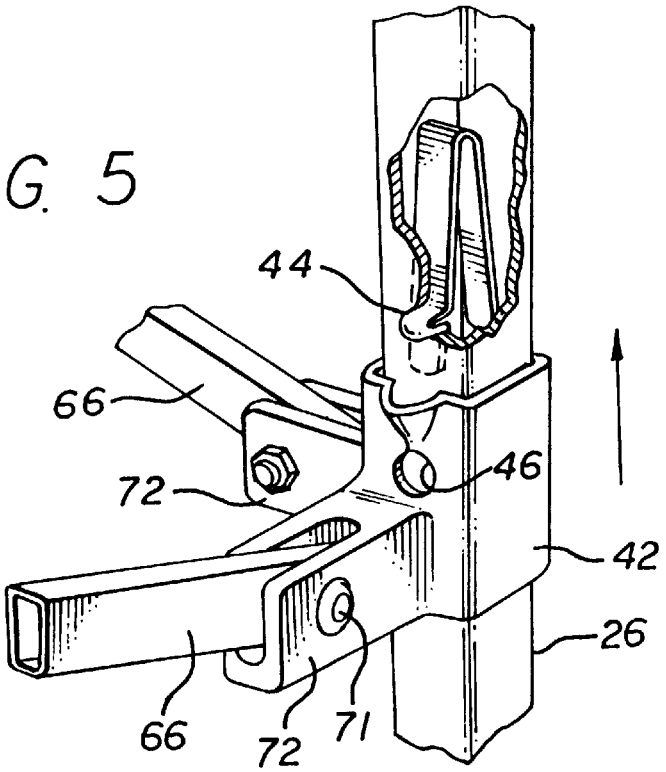

FIG. 13
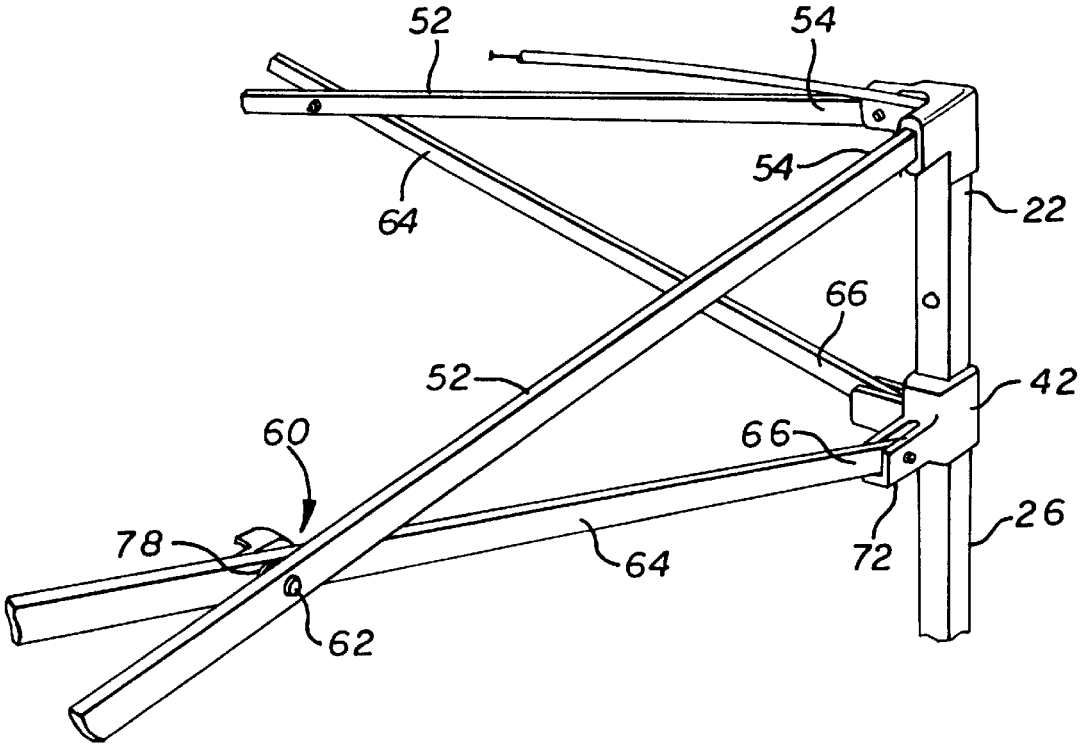
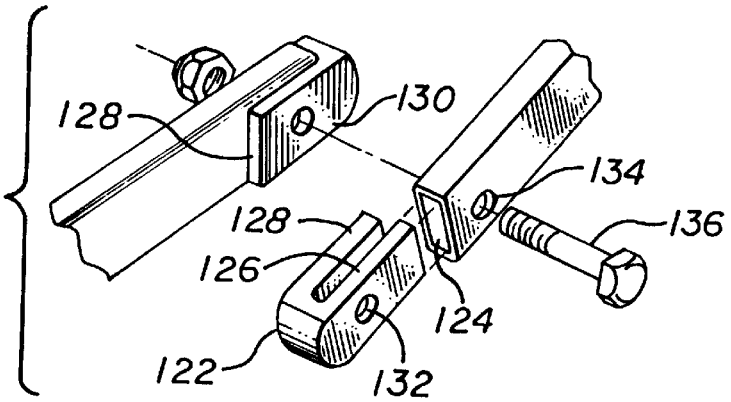
FIG. 16

COLLAPSIBLE SHELTER WITH FLEXIBLE COLLAPSIBLE CANOPY

This is a continuation of Ser. No. 08/823,616, filed Mar. 25, 1997, U.S. Pat. No. 5,797,412, which is a continuation of Ser. No. 08/604,801, filed Feb. 23, 1996, U.S. Pat. No. 5,632,293, which is a continuation of Ser. No. 08/279,476, filed Jul. 25, 1994, U.S. Pat. No. 5,511,572.

BACKGROUND OF THE INVENTION

1. Field of the Invention

This invention relates generally to folding, collapsible structures, and more particularly relates to a collapsible, field shelter structure having an elevated canopy.

2. Description of Related Art

Temporary shelters that can be easily transported and rapidly set up at emergency sites can be particularly useful in providing temporary care and housing. Such shelters can also be useful for non-emergency outdoor gatherings, such as for temporary military posts, field trips, and the like. One such quickly erectable, collapsible shelter having a framework of X-shaped linkages, telescoping legs, and a canopy covering the framework is described in my U.S. Pat. No. 4,607,656. The legs of that shelter are capable of telescoping to about twice their stowed length, and the framework of X-shaped truss pairs is capable of horizontal extension between the legs to support a canopy. The framework can be constructed of lightweight material, and the telescoping legs can be extended to raise the framework of the shelter. However, the height of the canopy is limited to the extended length of the legs, and the canopy is essentially flat, allowing for collection of precipitation and debris on top of the canopy, which can promote leaks and tears in the canopy. In addition, the size and stability of such shelters, particularly in the face of strong winds, are generally limited by the strength of the framework.

It would be desirable to provide an improved collapsible shelter with a support framework for the canopy that rises above the supporting legs, to provide for more headroom within the structure, to shed precipitation and debris from the top of the shelter, and to allow for a reduction in the size and weight of the legs and framework required to achieve an adequate height of the canopy. It would also be desirable to provide a. canopy that bends and collapses in strong winds, to reduce exposure of the shelter to the force of winds that can lift and topple the shelter, for improved strength and stability in strong winds, and to allow support of larger, lighter collapsible shelter structures. It would also be desirable if such a canopy were to be less expensive to construct than prior art canopies. The present invention meets these needs.

SUMMARY OF THE INVENTION

Briefly, and in general terms, the present invention provides for a collapsible shelter with a flexible, collapsible canopy framework that can be raised to provide increased headroom, strength and stability, and can be lowered to provide a reduced profile to the wind.

The invention provides for a collapsible shelter having at least three legs supporting a collapsible canopy supported by flexible poles removably mounted to the tops of the legs. At least two perimeter truss pairs of link members are connected to each of the legs on each side of the shelter between two adjacent legs. Each of the X-shaped perimeter truss pairs of link members are essentially identical, and include two link members connected together by a central pivot, with the first link member having an outer end connected to the upper end of one leg, and the second link member having an outer end slidably connected to the leg. The first and second link members are pivotally connected together in a scissors configuration so as to be extendable from a first collapsed position extending horizontally between two of the legs to a second extended position extending between the legs. The two perimeter truss pairs of link members on each side are connected together at their inner ends. The collapsible shelter preferably has four legs, but can also have three, five, or more legs.

At least two flexible pole members are also provided that are removably mountable to the upper ends of the legs of the shelter to extend across the shelter to form a structure for a flexible, collapsible canopy. The canopy also preferably includes a cover secured to the upper ends of the legs. In a currently preferred embodiment of the invention, the flexible pole members comprise a plurality of segmented poles formed from a plurality of pole sections that are removably connectable together, and that are removably mounted in indexing holes in hinge means affixed to the upper ends of the legs, and the pole members are similarly removably connected together by a central hub that is preferably permanently connected to an inner end of one of the pole members. When the pole members are connected together and inserted in the hinge means of the legs, the pole members forming the canopy can flex and move between a normal raised position and a lowered position by exertion of a downward force on the top of the canopy, such as by a strong wind, to reduce the profile of the shelter that would be exposed to the wind and still provide rain run off. To facilitate this aspect of the invention the flexible poles in a currently preferred embodiment are made of a composite material such as fiberglass, but a variety of materials such as metal tubing and other composites can be used for such purposes.

In one currently preferred aspect of the invention, the second link members are the same length as the first link members and the slider tab length cause the legs to be canted outward to a vertical position when the collapsible shelter is in a fully extended configuration. A hinge member is also preferably mounted to the upper end of each of the legs, and preferably includes a pair of sockets extending at approximately right angles from each other. The first link members are hingedly connected in the sockets of the hinge members to the upper ends of the legs. Each leg slider member also preferably includes a pair of sockets extending at approximately right angles from each other, and the second link members are hingedly connected in the sockets of the leg slider members, for reinforcement of the connection of the second link members to the leg slider members.

A plurality of clip members are also advantageously disposed on an inner surface of truss pairs of link members for removably receiving the pole members for temporary stowage of the pole members in a folded configuration. In another currently preferred aspect of the invention, the inner ends of the first and second link members also have an opening in which a reinforcing plug is inserted. The inner ends of the first link members on each side of the collapsible shelter are pivotally connected through the reinforcing plugs, and the inner ends of the second link members on each side of the collapsible shelter are pivotally connected through the reinforcing plugs, to reinforce the connections between the inner ends of the link members.

From the above, it can be seen that the present invention provides an economical, easily erected shelter that is less susceptible to toppling or damage from winds and still provides excellent shelter from sun and rain. These and other aspects and advantages of the invention will become apparent from the following detailed description, and the accompanying drawing, which illustrates by way of example the features of the invention.

BRIEF DESCRIPTION OF THE DRAWINGS

FIG. 2 is a perspective view of the collapsible shelter in a first stage of being unfolded by pulling the legs outwardly;

FIG. 3 is a perspective view of the collapsible shelter being unfolded by extending the perimeter truss pairs horizontally;

FIG. 4 is a perspective view of the collapsible shelter showing the raising of the truss pairs to lock them into position;

FIG. 5 is an enlarged perspective view of the slider connection of link members of a truss pair to a leg;

FIG. 13 is an enlarged perspective view of the inset portion of FIG. 12;

FIG. 16 is an enlarged, exploded view of the connection between the inner ends of adjacent truss pairs.

DETAILED DESCRIPTION OF THE PREFERRED EMBODIMENTS

The size and available headroom of previous collapsible shelters have been generally limited by the extended length of the legs of the structure, and provided essentially flat roof structures, allowing for collection of precipitation in pockets or puddles on top of the shelter. The size and stability of shelters can also be compromised by strong winds. The collapsible shelter of the invention provides for larger, lighter collapsible shelter structures, with a flexible, collapsible canopy structure which improves the stability of the shelter. Another substantial benefit of the invention is the relatively low cost construction compared to prior art designs.

Figure 1:
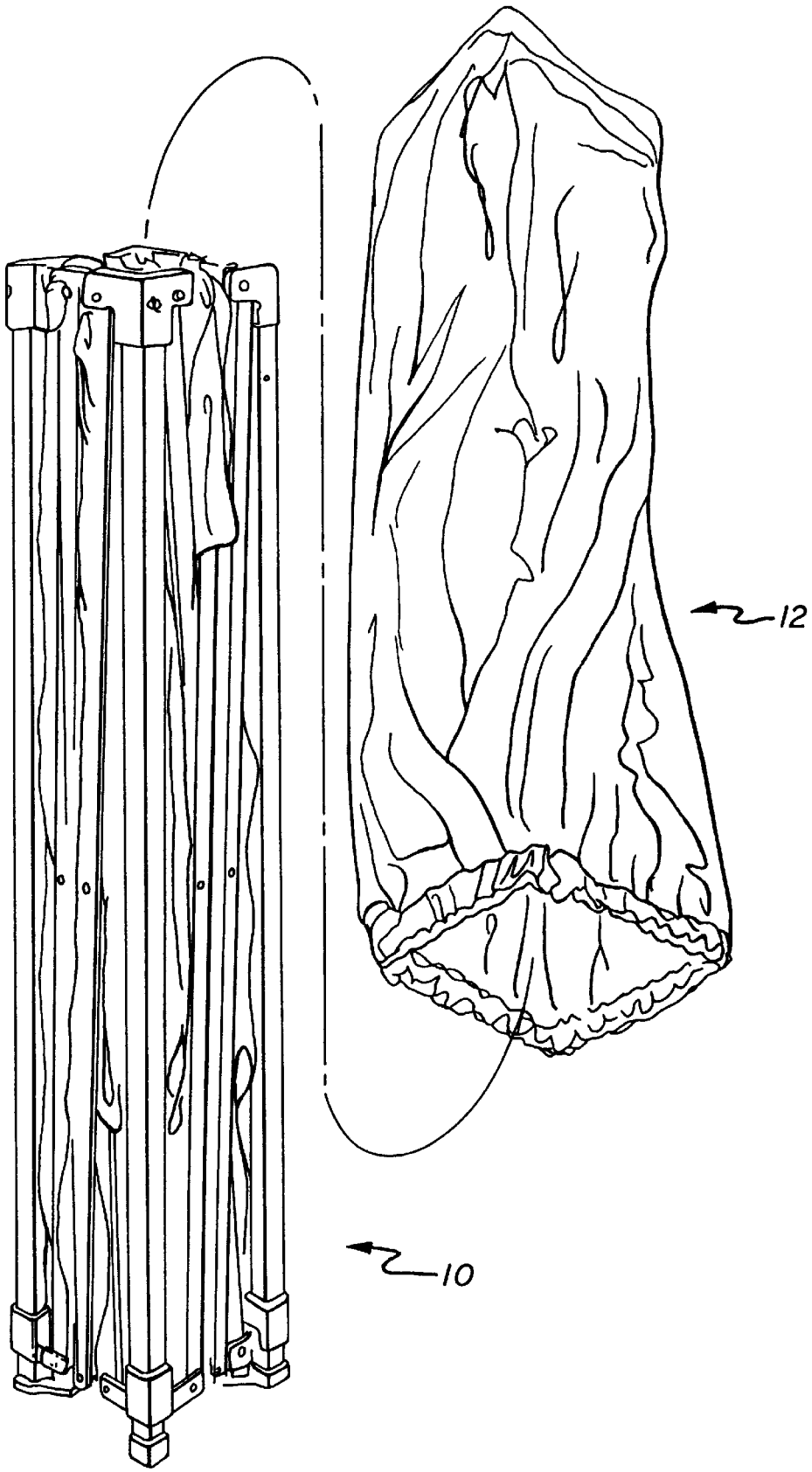
FIG. 1 is a perspective view of the collapsible shelter in a collapsed, folded configuration.
Figure 10:
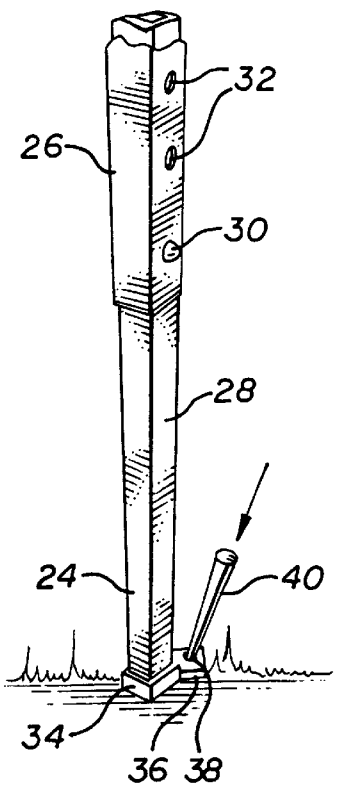
FIG. 10 is an enlarged perspective view of a lower portion of a leg.
Figure 11:
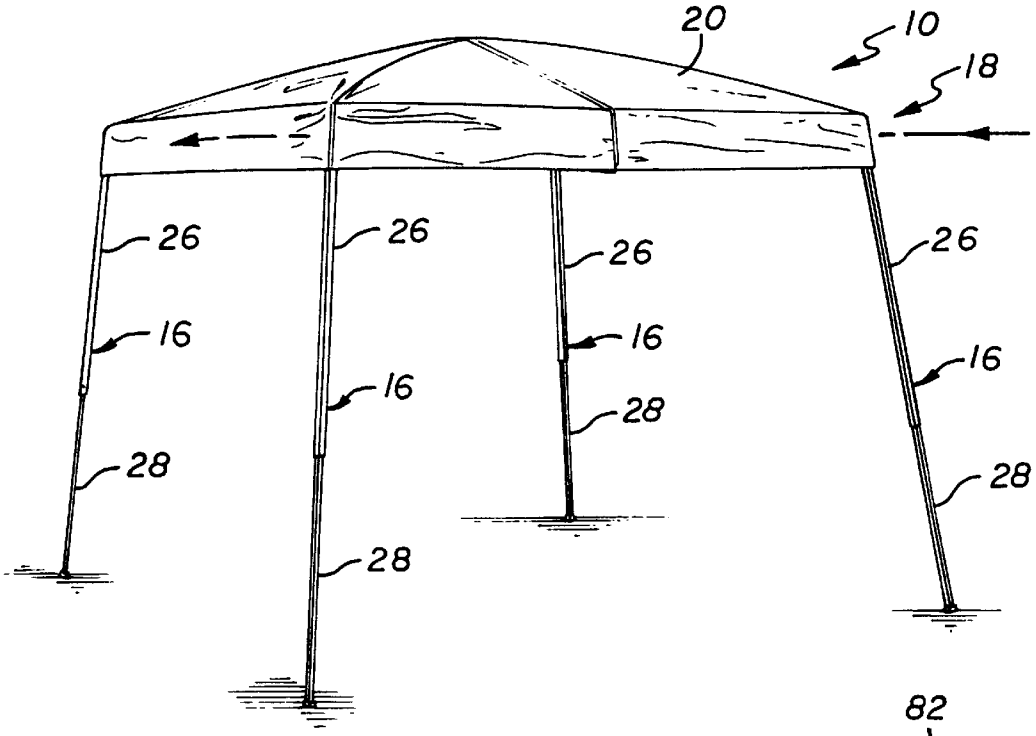
FIG. 11 is front perspective view of the collapsible shelter in a raised configuration.

As is illustrated in the drawings, and particularly referring to a first preferred four-sided embodiment shown in FIG. 1, the invention is embodied in a collapsible shelter 10, that can be collapsed and folded for carrying and transportation in a bag or sheath 12. In a currently preferred embodiment, the collapsible shelter includes a framework 14 of perimeter truss pairs attached to four legs 16, although the collapsible shelter can also be made with three, five, or more legs. The collapsible shelter also includes a flexible, collapsible canopy structure 18 that includes a canopy cover 20 that is preferably formed of nylon fabric, although the canopy could also be made of other suitable sheet materials, such as canvas, or other types of cloth fabric, or plastic. The canopy cover 20 is also preferably permanently affixed to the upper ends of the legs, such as by rivets or the like, although the canopy cover can also be included as a separate piece to be disposed over the framework of the collapsible shelter. With reference to FIGS. 10 and 11, each of the legs has an upper end 22 and a lower end 24, and preferably each leg includes telescoping upper and lower sections 26 and 28, respectively, with the telescoping lower section including a spring loaded detent pin 30 for indexing in apertures 32 provided in the upper section for locking the leg in a desired extended position. The extendable lower section also preferably includes a foot portion 34 for engagement with the ground or other floor surface, and preferably includes a flange 36 with an aperture 38 for receiving a stake or peg 40 for securing the legs to the ground.

As is best seen in FIGS. 5 and 13, a leg slider member 42 is also slidably mounted on the upper section of each of the legs. With reference to FIG. 5, a spring loaded detent pin 44 is also provided in the upper leg section for indexing with an aperture 46 in the leg slider member, as will be further explained below.

Figure 12:
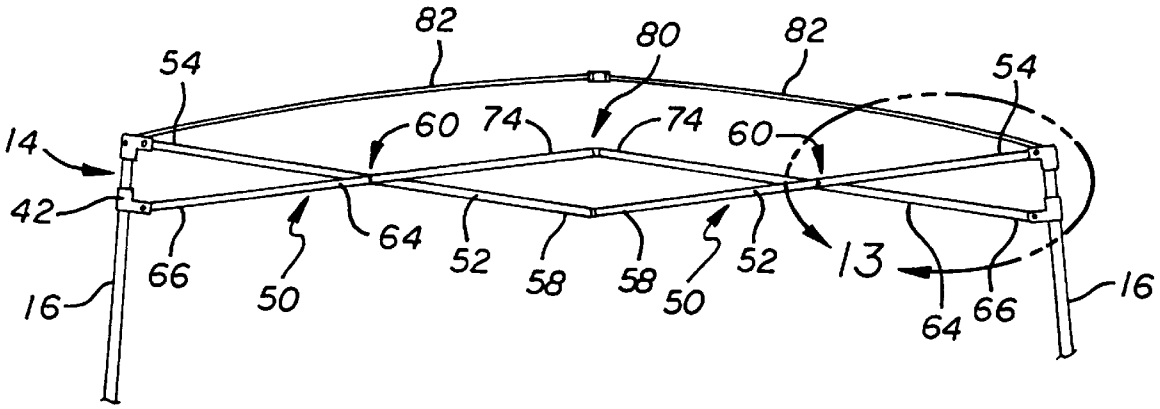
FIG. 12 is a partial sectional view of the upper portion of the raised canopy of the collapsible shelter.

Referring to FIGS. 12 and 13, in the currently preferred embodiment, the perimeter framework 14 includes a plurality of substantially identical perimeter truss pairs 50 of link members. The link members are preferably made of hollow aluminum tubing to provide a strong, stable, and lightweight structure, although other materials such as stainless steel tubing, for example, may also be suitable. Two perimeter truss pairs are connected to each leg, with each of the perimeter truss pairs including a first link member 52 having an outer end 54 connected to the upper end 22 of a leg, an inner end 58, a longitudinal center 60 of the link members, and a pivot point 62 at the approximate longitudinal centers of the first link members. Each of the perimeter truss pairs further includes a second link 64 having an outer end 66 pivotally connected to the leg slider member, thus slidably connecting the second link to the upper section of the leg. The second link members are preferably slightly longer than the first link members, so as to cause the legs to be slightly inwardly canted, for improved stability of the collapsible shelter when it is set up in the extended configuration.

Figure 6:
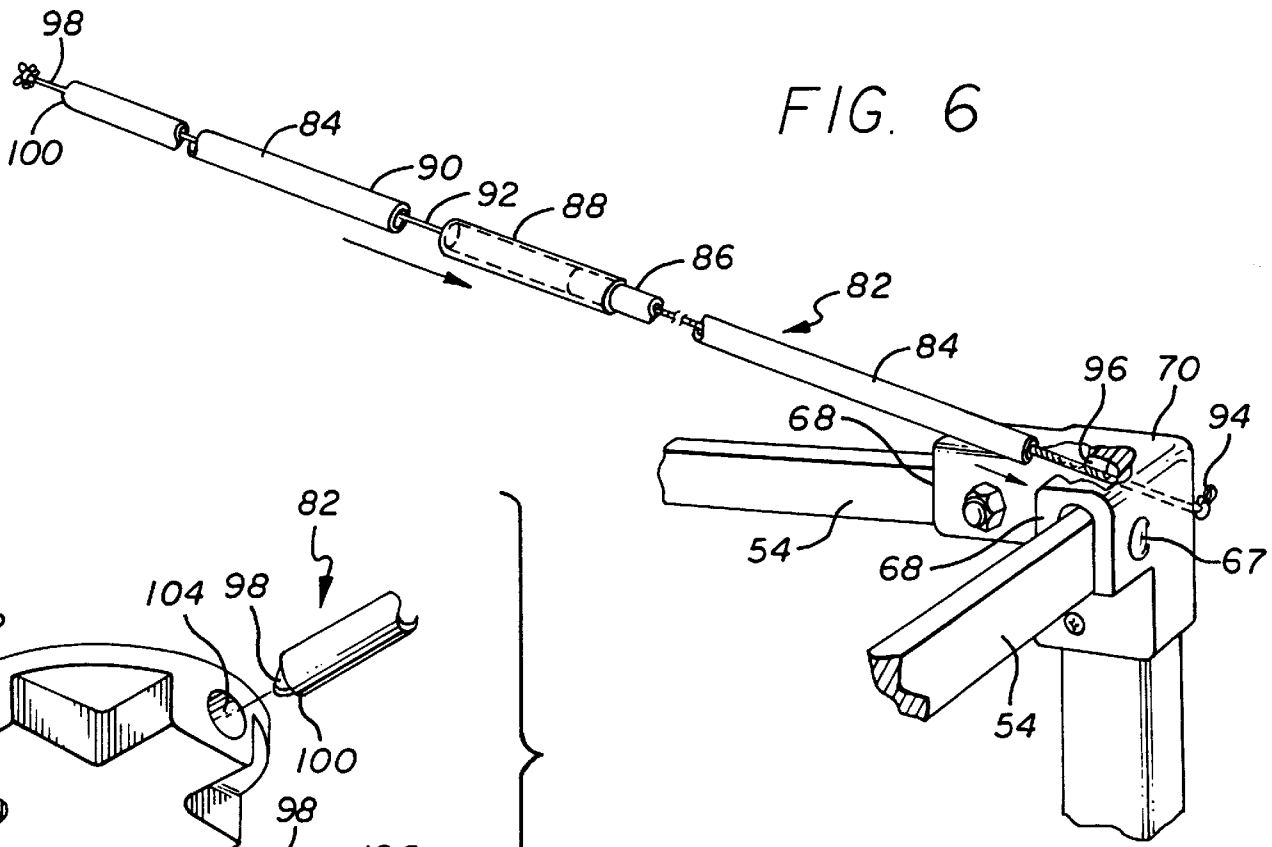
FIG. 6 is an enlarged perspective view of the hinge means for connecting the flexible pole members to the top of a leg of the collapsible shelter.

As is illustrated in FIG. 6, the outer end of each first link member is journalled by a bolt 67 for pivotal movement in a socket 68 of a hinge means 70 secured as by bolts or screws as a cap to the top end of the legs. The outer end of each second link member is similarly journalled by a bolt 71 for pivotal movement in a socket 72 of the slider member. Each hinge means includes two sockets 68 extending at approximately right angles from each other from the body of the hinge means, and each slider member similarly includes two sockets 72 extending at approximately right angles from each other from the body of the slider member. The hinge means and the slider member are each preferably made unitarily from a tough, molded plastic.

Figure 8:
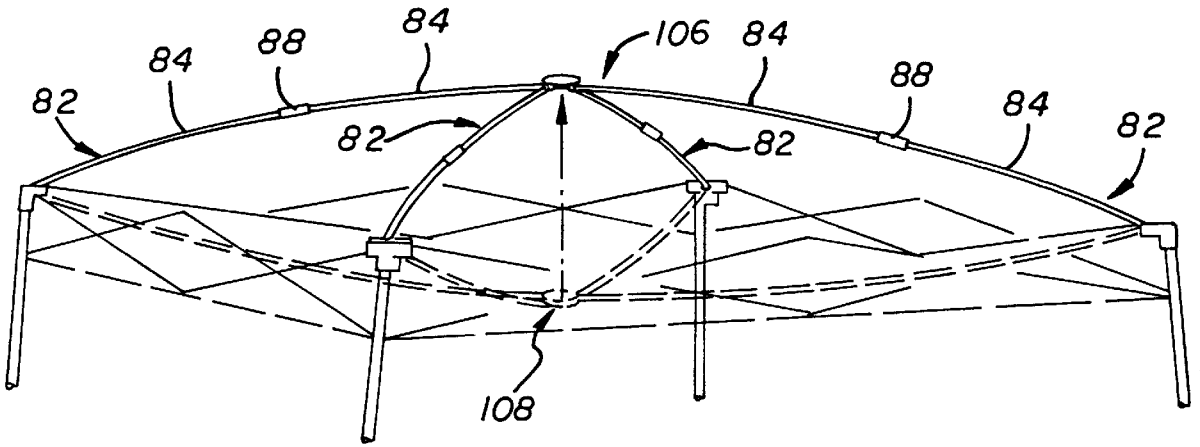
FIG. 8 is a side elevational view of the top portion of the collapsible shelter showing the pole members of the canopy structure in a normal raised position, and showing the lowered position in phantom.
Figure 17:
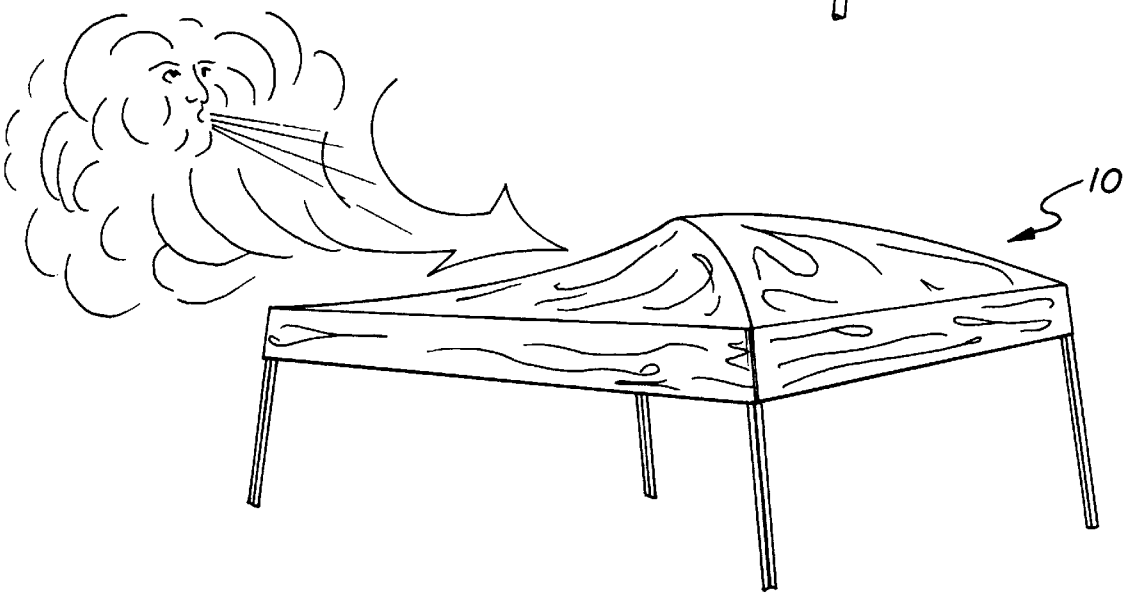
FIG. 17 is an illustration of the flexing of the collapsible canopy when exposed to strong winds.
Figure 9:
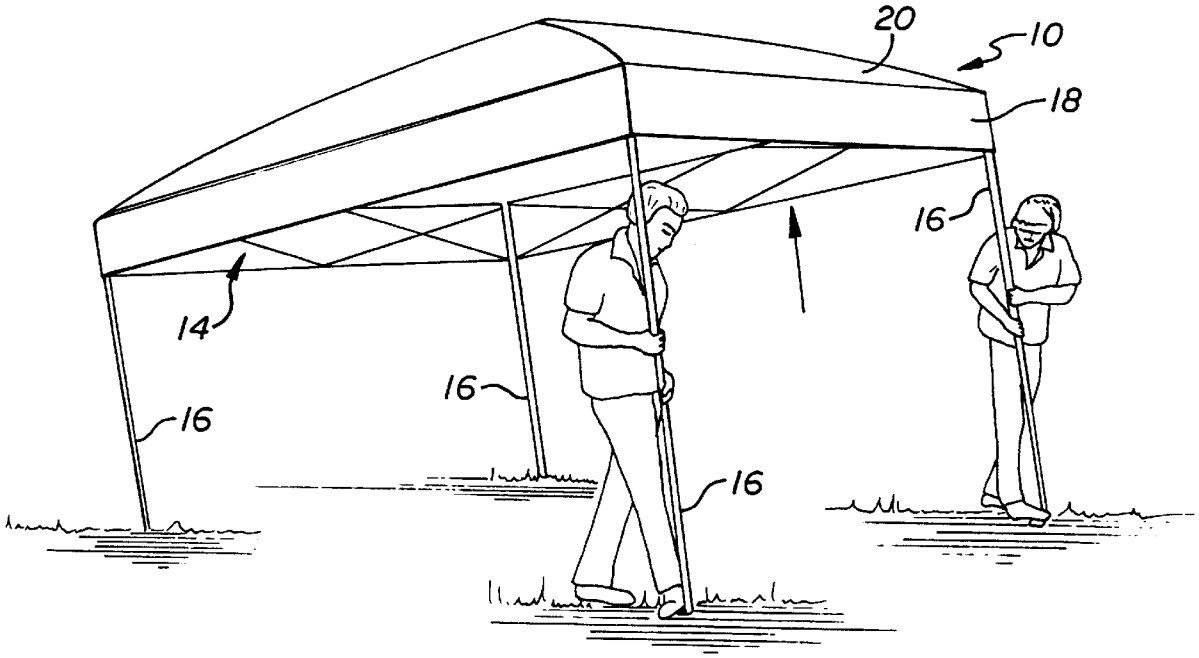
FIG. 9 is a perspective view showing the extension of the legs of the collapsible shelter.

The second link member of the perimeter truss pairs includes an inner end 74, a longitudinal center located adjacent to the first link member longitudinal center 60, and a pivot point 78 at the approximate longitudinal centers of the second link members adjacent to the pivot point of the first link members. The pivot points of the first and second links in each of the perimeter truss pairs are pivotally connected in a scissors configuration. The inner ends 58 and 74 of each perimeter truss pair are further preferably pivotally connected to the inner ends 58 and 74 of another perimeter truss pair at a junction 80 centered between two legs of one side of the shelter framework. The collapsible shelter framework of truss pairs is expandable and extendable from a folded configuration, as illustrated in FIG. 2, to an unfolded, extended configuration, as illustrated in FIGS. 8, 9 and 11, for example.

Figure 7:
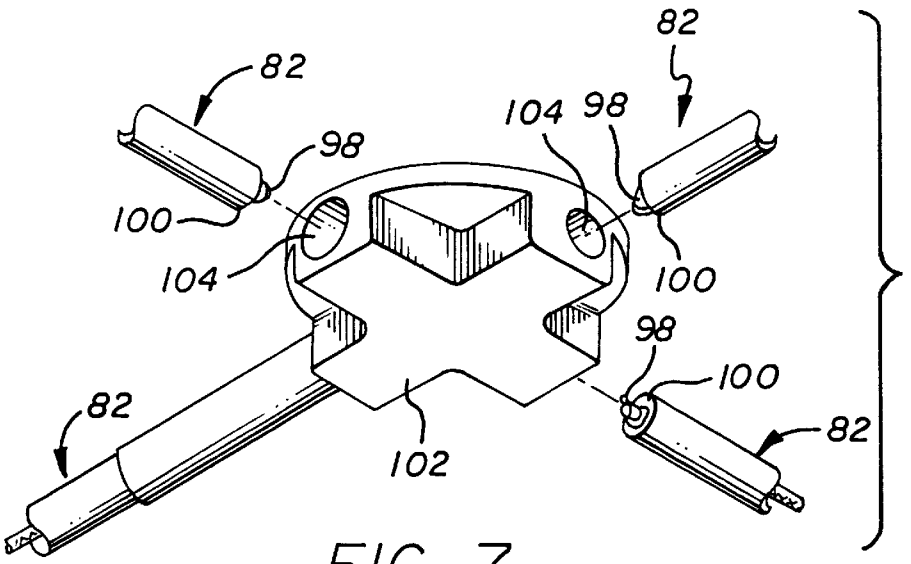
FIG. 7 is an enlarged perspective view of the central hub for connecting the pole members together.

In the currently preferred embodiment, four flexible pole members 82 are provided, corresponding to the number of legs, as is illustrated in FIGS. 6, 7 and 12. While a variety of materials such as metal tubing, composite tubing (tubing made of resin impregnated fibers) or solid composite poles may be used, the flexible pole members currently preferably each comprise segmented flexible poles formed from two fiberglass pole sections 84 that are removably connectable together, with an inner end 86 of one of the pole sections bearing a metal jacket 88, made of aluminum or steel for example, into which the adjacent inner end 90 of the other pole section is insertable, to join the pole sections together. The pole sections are preferably hollow, and an elastic cord 92 runs through the longitudinal centers of the pole sections. An outer end 94 of the cord of each pole member extends through an indexing aperture 96 in the hinge means, and is secured to the hinge means such as by a knot. The inner end 98 of the cord is secured to the inner end 100 of the pole member, such as by a knot, so that the pole sections of the pole member are biased together. The pole members are removably receivable for mounting in the indexing apertures 96 in the hinge means affixed to the upper ends of the legs.

In a currently preferred embodiment, a central hub member 102, having four symmetrically located indexing holes 104 for removably receiving the inner ends of three pole members, and for permanently receiving the inner end of a fourth pole member, mounted in a hub indexing hole, such as by an adhesive such as epoxy, for example, for joining the pole members together. The central hub member is also preferably formed of tough, molded plastic. The pole members thus can be removably mounted to the upper ends of the legs of the shelter to extend across the shelter peaking in the center of the collapsible shelter to form a canopy structure under the top fabric cover, to form a flexible, collapsible canopy. The pole members are preferably slightly longer than the straight line distance between the tops of the legs at the opposite corners of the collapsible shelter, so that the pole members will normally be bowed when the pole members are connected together and between the central hub member and the legs. Alternatively, at least two central flexible pole members can be provided, not connected by a central hub member, extending between hinge means at opposite corners and permanently connected. to a corresponding number of the hinge means by the elastic cords, and removably insertable in the opposite corner hinge means. Initially, when the pole members are connected together and inserted in the hinge means of the legs, the pole members forming the canopy will typically be bowed downwardly, and can be pushed upward to snap into an upwardly bowed, normal canopy configuration. The pole members forming the canopy can also flex and move from the normal raised position 106 to a lowered position 108 by pulling the pole members down, or by exertion of a downward force on the top of the canopy, such as by a strong wind, to reduce the profile of the shelter that would be exposed to the wind.

Figure 14:
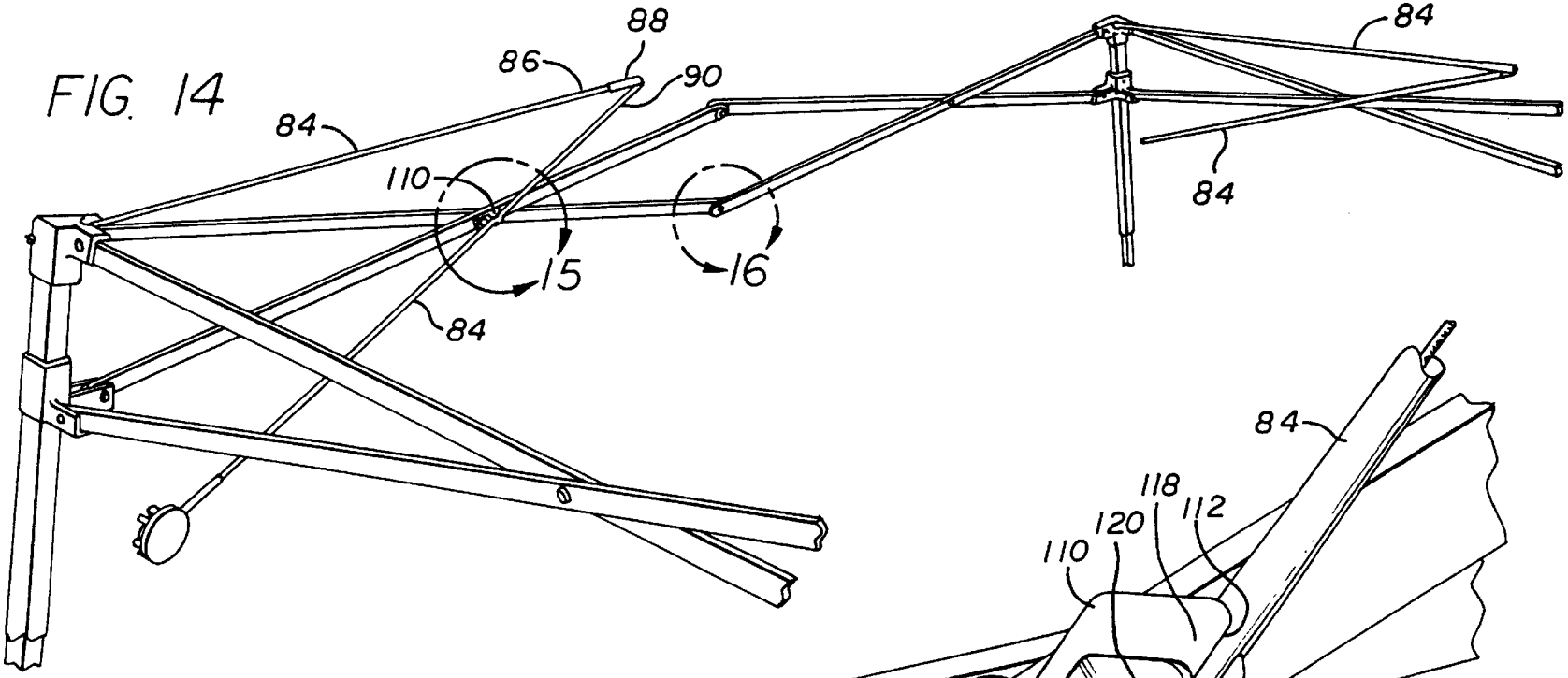
FIG. 14 is a partial perspective view of the collapsible shelter showing the folding and capturing of a section of a pole member.
Figure 15:
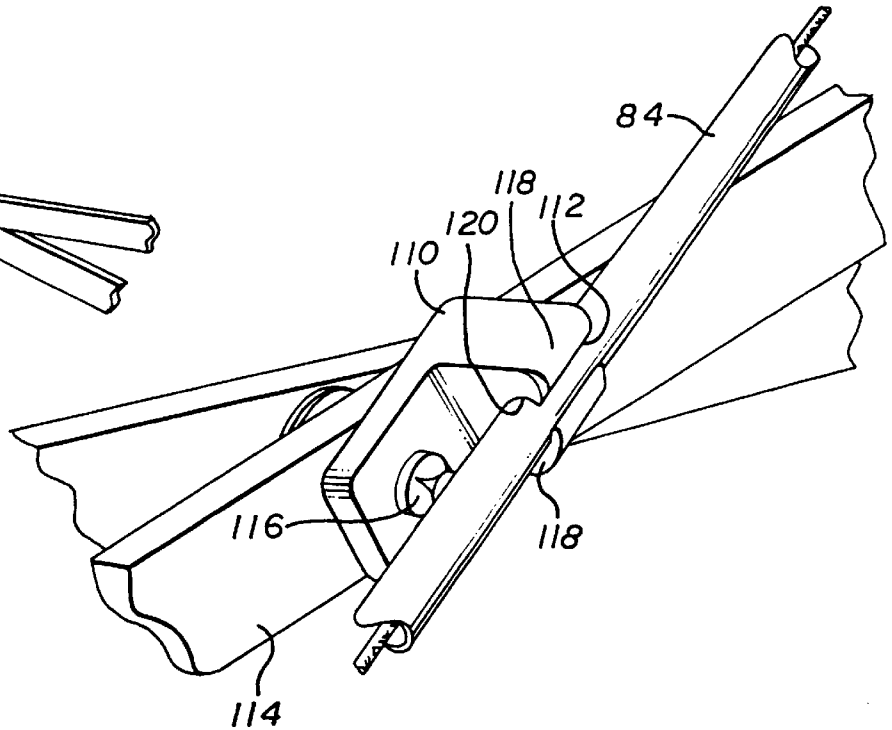
FIG. 15 is an enlarged view of the capture member and section of the pole member from FIG. 14.

As is illustrated in FIGS. 14 and 15, a clip 110, having a slot 112 for receiving and gripping the inner segment of a pole member, is preferably mounted to the inside surface 114 of each of the second link members, such as by screws 116, for example, for retaining the pole members in an out of the way position when they are folded for storage of the collapsible shelter. The clips are preferably formed of a unitary piece of plastic having jaw members 118 with a rounded inner contour 120 for receiving a pole member section. Alternatively, the clips can be spring clips made of spring steel, for example.

As is illustrated in FIG. 16, the first and second link members are preferably hollow, and preferably include a reinforcing plug 122, presently preferred to be a rigid plastic, that is inserted in the openings 124 in the inner ends of each of the first and second link members. The reinforcing plugs preferably have a forked shape, with a first prong 126 inserted into the inner end of the link member, and a second prong 128 having a generally flat outside surface 130 disposed outside the link member adjacent to another second prong of an adjacent reinforcing plug. An aperture 132 extends through the first and second prongs of the reinforcing plug, corresponding to an aperture 134 through the inner end of the link members, for receiving bolts 136 hingedly connecting the inner ends of the link members for pivotal movement. The reinforcing plugs permit the bolts pivotally connecting the inner ends of the link members to be tightened securely, without comprising the structural integrity of the link members, and facilitate a moderately frictionless hinged movement of the inner ends of the link members during folding and unfolding of the collapsible shelter.

In light of the above description, it will be apparent that the invention provides for an improved, quickly erectable, collapsible shelter having a flexible, collapsible canopy that can be moved between a raised position providing more headroom and a lowered position presenting a reduced profile for resisting the force of strong winds on the shelter.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A collapsible shelter, comprising:

at least three legs, each of said legs having an upper end and a lower end;

at least two perimeter truss pairs of link members connected to each of said legs, each of said perimeter truss pairs of link members including first and second link members, pivotally connected together said first and second link members each having inner ends having a surface defining an opening, a reinforcing plug disposed in each of said openings of said inner ends of said first and second link members, and a bolt pivotally connecting each of said inner ends of said second link members on a side of the collapsible shelter through said reinforcing plugs, whereby said bolt can be tightened on said inner ends of said second link members without compromising the structural integrity of the first and second link members.

2. The collapsible shelter of claim 1, each of said first and second link members further including outer ends, said outer of end of said first link member connected to the upper end of one said leg, and said outer end of said second link member slidably connected to the one said leg.

3. The collapsible shelter of claim 2, further including a leg slider member slidably mounted to each of said legs, and wherein each of said second link members is pivotally connected to one said leg slider member.

* * * * *